US010363186B2

(12) United States Patent
Bader

(10) Patent No.: US 10,363,186 B2
(45) Date of Patent: Jul. 30, 2019

(54) MODULAR, DEFORMABLE, CUSHIONED, RESISTIVE INFANT POSITIONING SYSTEM AND METHOD

(71) Applicant: Lisa Bader, Papillion, NE (US)

(72) Inventor: Lisa Bader, Papillion, NE (US)

( * ) Notice: Subject to any disclaimer, the term of this patent is extended or adjusted under 35 U.S.C. 154(b) by 637 days.

(21) Appl. No.: 14/830,904

(22) Filed: Aug. 20, 2015

(65) Prior Publication Data

US 2016/0051430 A1 Feb. 25, 2016

Related U.S. Application Data

(60) Provisional application No. 62/039,962, filed on Aug. 21, 2014.

(51) Int. Cl.

| | |
|---|---|
| ***A61G 7/00*** | (2006.01) |
| ***A61G 7/065*** | (2006.01) |
| ***A47D 15/00*** | (2006.01) |
| ***A47C 31/12*** | (2006.01) |
| ***A47D 13/08*** | (2006.01) |
| *A61G 11/00* | (2006.01) |

(52) U.S. Cl.

CPC ..... *A61G 7/065* (2013.01); *A47C 31/123* (2013.01); *A47D 13/08* (2013.01); *A47D 15/005* (2013.01); *A61G 11/00* (2013.01)

(58) Field of Classification Search

CPC ..... A61G 7/065; A61G 7/07; A61G 7/072; A61G 7/075; A61G 7/08; A61G 7/052; A61G 7/0522; A61G 7/0525; A61G 7/0526; A61G 7/1084; A61G 13/121; A61G 13/127; A61G 15/12; A61G 15/125; A47D 13/08; A47D 13/083; A47D 15/005; A47D 15/008

USPC ..... 5/55, 657, 652, 425; 602/34, 17

See application file for complete search history.

(56) References Cited

U.S. PATENT DOCUMENTS

| | | | | |
|---|---|---|---|---|
| 774,996 A | | 11/1904 | Starkwather | |
| 2,589,303 A | | 8/1946 | Sourbeck | |
| 4,712,258 A | * | 12/1987 | Eves ..... | A47D 5/006 5/420 |

(Continued)

FOREIGN PATENT DOCUMENTS

WO WO 2014/125472 A1 * 8/2014

OTHER PUBLICATIONS

Mimos (R) Air Spacer Pillow. From Mimos Pillow UK at mimospillow.blogspot.com. Accessed Sep. 20, 2013.

(Continued)

*Primary Examiner* — Keri J Nelson
*Assistant Examiner* — Adam Baker
(74) *Attorney, Agent, or Firm* — Connie R. Masters

(57) ABSTRACT

A modular, deformable, repositionable, cushioned gentle cushioned, resistive infant positioning system and method for use with infants is provided that includes first and second tubular pillows each having two longitudinally-elongated chambers adjoined at a first and second pillow lateral flexure-enabling element, respectively, and a third compact pillow. The second tubular pillow is preferably wider than the first tubular pillow and includes two straps. Methods of using the three pillows of the cushioned, resistive infant positioning system are presented that provide positioning, calming, and/or the prevention and/or the correction of head shape deformations.

8 Claims, 13 Drawing Sheets

(56) References Cited

U.S. PATENT DOCUMENTS

| | | | | |
|---|---|---|---|---|
| 4,790,042 | A | 12/1988 | Reich | |
| 5,165,130 | A * | 11/1992 | Wendling | A47D 13/08 5/424 |
| 5,392,785 | A * | 2/1995 | Donahue | A47D 13/08 128/873 |
| D370,585 | S | 6/1996 | Faithfull | |
| 5,530,974 | A * | 7/1996 | Rains | A47C 21/08 5/630 |
| 5,692,246 | A * | 12/1997 | Benedick | A41D 13/1245 2/455 |
| 6,161,239 | A | 12/2000 | Grazel | |
| 6,481,032 | B2 * | 11/2002 | Milano | A47D 15/008 5/632 |
| 7,856,688 | B2 * | 12/2010 | Dockendorf | A45C 9/00 5/425 |
| 8,332,978 | B2 | 12/2012 | Warnock | |
| 8,419,128 | B1 | 4/2013 | Leach | |
| 2003/0226190 | A1 | 12/2003 | Jackson | |
| 2004/0216231 | A1 * | 11/2004 | Rao | A47D 15/008 5/482 |
| 2008/0092300 | A1 * | 4/2008 | Joe | A47D 13/08 5/655 |
| 2008/0289109 | A1 | 11/2008 | Jackson | |
| 2009/0031500 | A1 * | 2/2009 | Daly | A47D 13/08 5/655 |
| 2012/0199134 | A1 * | 8/2012 | Carson | A61G 7/0755 128/845 |

OTHER PUBLICATIONS

Theraline Baby Pillow. From www.theraline.co.uk/babypillow.htm. Accessed Sep. 20, 2013.

Bobkids Baby Infant Head Rest Support Cotton Pillow Memory Foam Prevent Flat Head. From Amazon.com at www.amazon.com/Bobkids-Infant-Support-Cotton-Prevent/dp/B00CEP1EEA. Accessed Sep. 20, 2013.

* cited by examiner

MODULAR, DEFORMABLE, CUSHIONED, RESISTIVE INFANT POSITIONING SYSTEM AND METHOD

CROSS REFERENCE TO OTHER APPLICATIONS

This non-provisional application claims the benefit of U.S. Provisional Patent Application No. 62/039,962, filed on Aug. 21, 2014, which is incorporated herein in its entirety.

FIELD OF INVENTION

This invention relates generally to a system and method for positioning an infant and/or calming an infant and/or for correcting or preventing infant head deformities, and, more particularly, to three separate deformable pillows filled with an inner resilient cushioning material that is manually repositionable, wherein the three pillows include two tubular pillows each having a central flexure-enabling element and a compact pillow.

BACKGROUND OF THE INVENTION

The environment of the neonatal intensive care unit (NICU) is structured to save the lives of premature babies. While the strategies used in the NICU are lifesaving and necessary, these strategies produce ancillary risks.

Infants in the NICU—even well preemies who are only underweight—are at risk of developmental delay, learning disabilities and sensory processing disorders. A full nine-month gestation provides improved neuromotor development compared to the reduced gestation period of infants born prematurely. In essence, the neuronal pathways of the brain simply do not develop the same as they would in the comfort of the mother's womb. Research shows that if pain and stress are decreased in the preterm infant, brain development is improved. Pain and stress can be diminished through positioning and calming. For instance, a clinician may place a hand on the head and a hand on the body to comfort and gently confine the infant. Though this is calming and helps develop coping skills, the clinician in the busy NICU setting cannot maintain such a time-intensive calming means for long periods.

Research shows that therapeutic positioning and developmental support have positive effects on functional outcomes of NICU graduates and that a lack of attention to developmental positioning can lead to fine and gross motor delays, developmental delays, and head shape deformities. Achieving the best practices in positioning, though recognized as important, is not easy with the currently available products. Positioning of the infant should include support with boundaries leading to symmetrical posture and decreased stress, rotation of the infant into different positions to promote head shaping and motor development, and support to prevent the infant from sliding downward in the crib that occurs due to the elevation of the head of the crib to reduce reflux that is prevalent in premature babies.

Many and numerous devices have been developed to attempt to provide assistance in positioning an infant or in preventing/correcting head shape deformities. One category of these conventional positioning devices provides support for an infant's head through a preformed head-shaped or c-shaped head support, which includes the following: the formed pillow of U.S. Pat. No. 8,332,978 issued to Warnock; the head-shaped form of U.S. Pat. No. 8,590,536 and of U.S. Pat. No. 8,074,312 that are both issued to Tullous; the Bobkids™ baby head rest support of cotton and memory foam; the wedge-shaped pillow of U.S. Pat. No. 8,281,435 issued to Kent; the Mimos® Air Spacer Pillow; the cranial suspension apparatus to prevent positional plagiocephaly of U.S. Pat. No. 6,052,849 issued to Dixon; the oval pillow with a central depression of US Patent Publication No. 2010/0180381 filed by Law; the oval-shaped pillow with a center opening of U.S. Pat. No. 8,069,856 issued to Kell; the doughnut-shaped and gel-filled pillow of U.S. Pat. No. 6,052,850 issued to Salido; the "Inflatable Neck Pillow" of U.S. Design Pat. No. 322,380 issued to El-Asir; the oblong formed shape with a center "form fit" of U.S. Pat. No. 7,322,062 issued to Matthews; the "Orthopedic Pillow" of U.S. Design Pat. No. 416,745 issued to Noyes, the U-shaped head receiver of U.S. Pat. No. 7,698,763 issued to Warnock; and the "Preformed Shape Headrest" of U.S. Pat. No. 6,536,058 issued to Chang. Another set of devices provide both a head and a body support, which include the following: the support for use in a car seat of U.S. Pat. No. 8,419,128 issued to Leach; a "Cushion for Baby Chair" disclosed in U.S. Pat. No. 7,806,471 issued to Nishimoto of Combi Corporation; and EP Patent No. EP1665958A1 filed by Kassai. But in all of these patents, publications and products, the head support is formed and is not reconfigurable to fit the size, shape and variations in position needs of a particular baby and so is limited in usefulness. It does not provide body support with boundaries, does not facilitate rotation of the infant into different positions, does not prevent the infant from sliding downward in the crib, and is limited in its effectiveness to prevent or treat head shape deformities. In the three patents that disclose an additional lower body support, the support is provided only along the exterior of the legs and cannot be repositioned to below the infant, such as to keep the infant from sliding down in the crib. Additionally, these conventional positioning devices provide, at most, limited support with boundaries.

Some other patents disclose pillows that incorporate a hand-shaped element, presumably based on the idea that human hands are comforting to an infant. These include U.S. Pat. No. 4,790,042 issued to Reich that discloses a baby comforter with side arms with attached hands. The side arms can be wrapped around the infant with the hands joined to form a restraint harness. Though the arms can be positioned around the infant, the fixed attachment to the comforter restricts the placement of the arms to a single location, so does not provide for repositioning of an infant, for preventing an infant from sliding downward in a crib, for support with boundaries, or for preventing or correcting head shape deformities. U.S. Design Pat. No. 370,585 to Faithful discloses a single elongated cylinder (representational of arms) with attached hands capable of forming an oval cushion. Though the use is not disclosed, it appears an infant could be positioned within the oval that is formed, but no repositioning assistance, support with boundaries, or prevention/correction of head shape formation could be provided due to the limitation of the single type of formed oval. US Patent Publications No. 2008/0289109 and No. 2003/0226190 filed by Jackson both disclose a pillow imitating a human hand that can be positioned onto a baby, thereby emulating the placement of a human hand onto the baby. While a hand shape may potentially provide comfort and/or calming and/or may by aesthetically appealing or provide emotional comfort to parents, it provides only meager repositioning possibilities or prevention of slipping downward in the crib; it provides no support with boundaries and no prevention/correction of head shape formation due to the limitations inherent in the hand structure.

U.S. Pat. No. 6,161,239 issued to Grazel discloses an elongated sleeve containing polymeric pellets for positioning an infant in a stabilized, simulated fetal position. Though the one-piece construction of the sleeve is stated as an advantage, it is also limiting in the number and types of positions that are enabled, in the provision of support with boundaries, and in the prevention of downward slipping of the infant. Additionally, to allow the sleeve-like device to be bent into the desired position, the fill density of the pellets per volume must be prescribed and must be sufficiently low to provide for the manual bending, as there is no mechanism to facilitate bending beyond reducing the number of pellets within the device.

An additional positioning aid is found in the shaped pillow product that holds or supports the body of the child disclosed in U.S. Pat. No. 7,000,275, which is issued to Brown and assigned to The Boppy Company. This pillow also does not provide support with boundaries suitable for use in an NICU and only aids in retaining the infant in a single position and is of very limited value in rotation through multiple positions because of its fixed shape.

Thus one or more of the numerous currently available products, disclosed inventions, or even the commonly used makeshift rolled towels or sheets (repurposed for positioning) may be used to at least partially meet some of the needs of an infant in NICU. However, a more efficient and effective system is needed (1.) that meets the goal of positioning the infant in flexion, containment, alignment, and comfort while allowing the infant some movement against boundaries; (2.) that can be used both in the isolette (incubator) and later when the infant is moved to the open crib; and (3.) that prevents the infant from slipping downward in the crib or isolette.

Furthermore, infants in the NICU often develop positional head deformities as a result of their NICU stay. Scaphocephaly, in which the head is disproportionately long and narrow, is most often seen in the NICU because premature babies do not breathe as well on their backs. Therefore, these infants are often positioned either on their side or stomach when in the isolette, resulting in a long narrow head shape. Plagiocephaly, in which one side of the head is flattened and the head appears "oblique" in shape, is also seen to a lesser degree. This is often a result of the infant having a preferential head turn. It is estimated that up to 85% of infants have a preferential head turn, and often the preference is to turn the head to the right. It is suspected this is due to both caregiving practices and the way the infant is positioned in the womb prior to delivery. The statistics are wide ranging but it is estimated that up to 47% of babies have a head shape deformity and nearly 20% of infants born prematurely will have a severe head shape deformity.

Even full-term infants are at risk of deformational plagiocephaly. After the 1992 recommendation by the American Academy of Pediatrics that all infants sleep on their backs to prevent sudden infant death syndrome (SIDS), plagiocephaly increased dramatically in frequency. Studies have shown that currently nearly half of all infants demonstrate some degree of plagiocephaly due to this preferential positioning of the head on a firm, hard mattress.

Once the infant reaches about six to twelve months of age, the bones in the head harden and the head shape deformity can only be corrected with an orthotic helmet. The helmet, which can cost up to several thousand dollars, is not always covered by insurance and may not provide a satisfactory result. Therefore, a system that prevents head shape deformity and/or corrects the problem at a very young age would be very desirable.

Accordingly, there is a need for a system and method of use that can be optionally used for improved infant positioning (including rotating an infant through multiple advantageous positions providing flexion, containment, alignment, movement against boundaries), to promote calming an infant, and to prevent and/or correct positional head deformities.

BRIEF SUMMARY OF THE INVENTION

The modular, deformable, cushioned, resistive infant positioning system and method provided includes a first narrower tubular pillow, a second wider tubular pillow with two straps, and a compact pillow. Various methods are presented that utilize this cushioned, resistive infant positioning system to provide desired positioning of the infant, calming of the infant, and/or positional head deformity prevention and/or correction. In one exemplary method of use, the compact pillow may be placed under the infant's head, the narrow tubular pillow may be manually formed into a U-shape and placed around the infant's head, and the wider tubular pillow may be manually shaped into a U-shape and arranged around the infant's body and legs with its straps used to secure the tubular pillows in position around the infant.

While numerous devices have been developed that allow an infant to be positioned in a single desirable position, the modular, deformable cushioned, resistive infant positioning system and method of the present invention system and method of the present invention provides the ability to position the infant in a multitude of advantageous positions while additionally providing calming and head shape deformity prevention/correction. The cushioned, resistive infant positioning system is characterized by a ready capability to be manually adaptable to new, different and changing requirements.

An object of the present invention is to provide a versatile cushioned, resistive infant positioning system and method that can be used to manually situate an infant in numerous advantageous positions.

An additional object is to provide a cushioned, resistive infant positioning system and method that can be used for calming and soothing an infant.

A further object is to provide a gentle cushioned, resistive infant positioning system and method that can avert and/or rectify a head shape deformity in infants.

These and other objects, features and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Shown throughout the figures, the present invention is directed toward a modular, deformable, cushioned, resistive infant positioning system and, additionally, to a method of use of the disclosed system.

The method of use includes using the cushioned, resistive infant positioning system for positioning an infant while providing support with boundaries, for facilitating calming and stress relief, and/or for prevention or correction of positional head deformities both in and out of the isolette (incubator).

Figure 1:
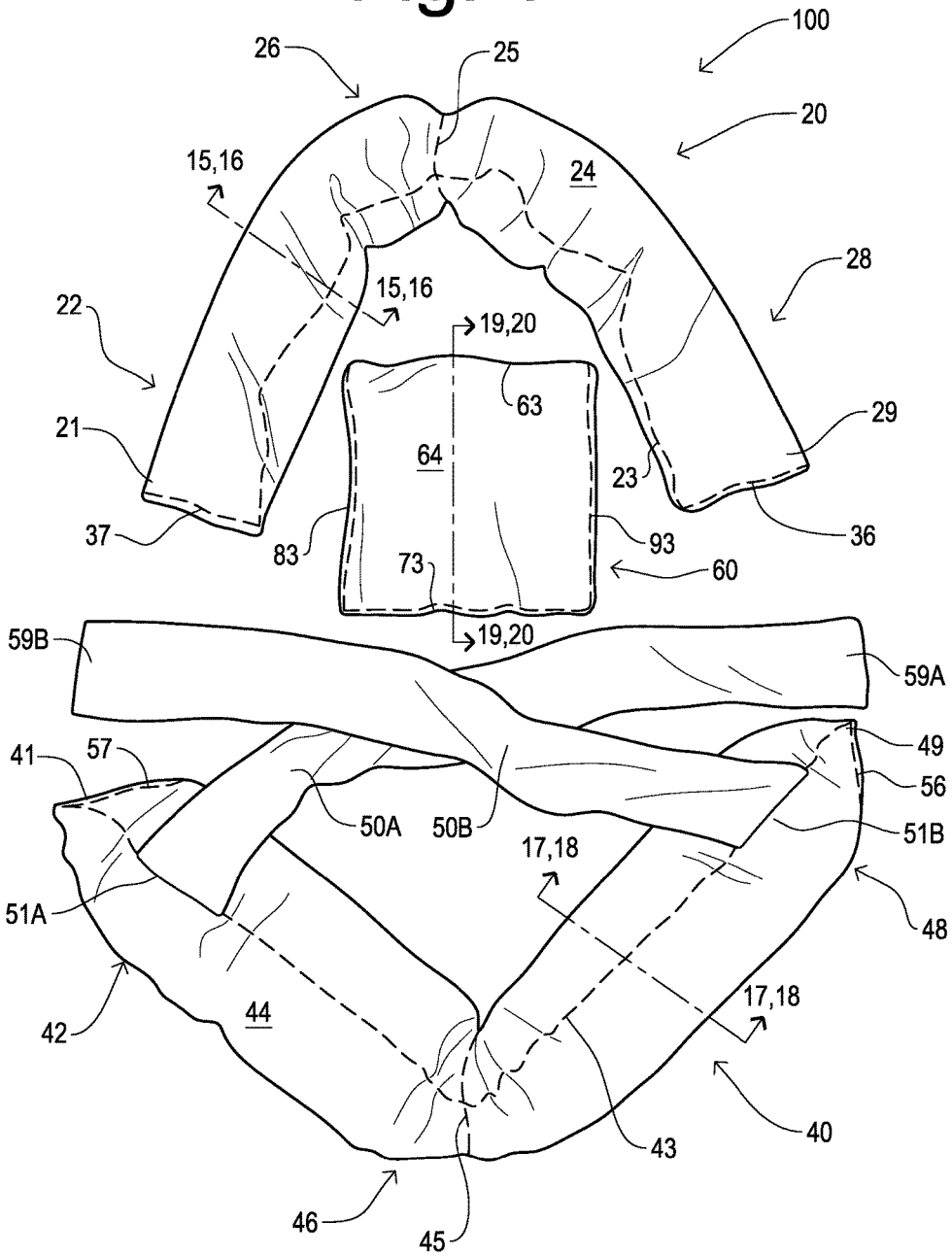
FIG. 1 is a top view of the three pillows comprising the modular, deformable, cushioned, resistive infant positioning system and method.

Referring now to FIG. 1, a cushioned, resistive infant positioning system, shown generally as reference number 100, is illustrated in accordance with a preferred embodiment of the present invention. As shown, the cushioned, resistive infant positioning system 100 comprises a first tubular pillow 20, a second tubular pillow 40 and a compact pillow 60. Each of the pillows 20, 40, 60 can be independently, manually located by clinicians to support, comfort and position a portion of the infant's body. Also, each of the pillows 20, 40, 60 are manually shapeable and deformable, due to a manually manipulatable resilient cushioning material 35 (FIGS. 14-19) contained within the pillows 20, 40, 60. For convenience of discussion, the designations "left" and "right" will refer to the orientation of pillows 20, 40, 60 as shown in FIG. 1, not to the orientation of the right and left sides of an illustrated infant 90.

Figure 2:
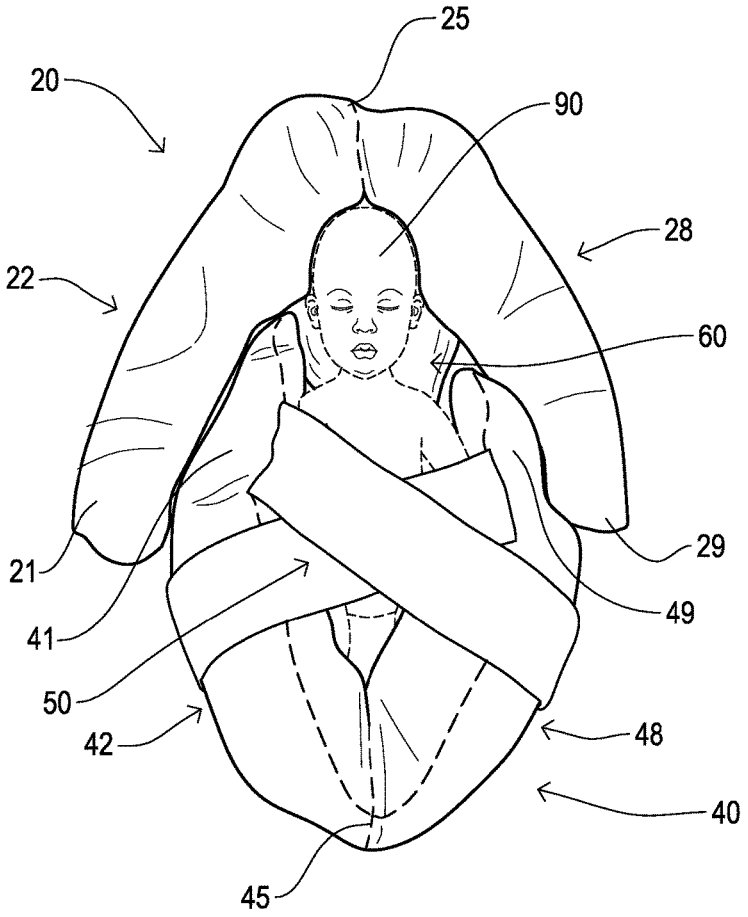
FIG. 2 is a top view of the modular, deformable, cushioned, resistive positioning and repositioning and method of the present invention in the environment of use with the infant in a supine position in an isolette.
Figure 14:
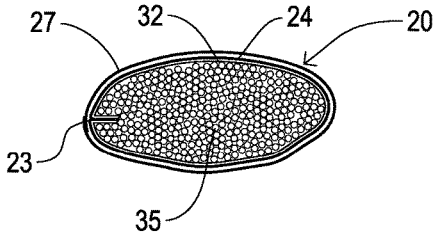
FIG. 14 is a cross-sectional view of a first aspect of the first tubular pillow of the present invention.
Figure 15:
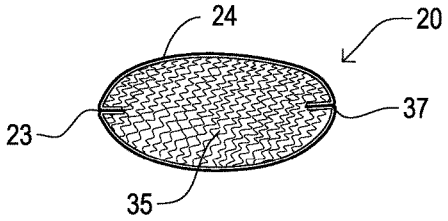
FIG. 15 is a cross-sectional view of a second aspect of the first tubular pillow of the present invention.

The first tubular pillow 20 is a longitudinally-elongated tubular filled pillow having an outer shell 24 that encloses and contains an amount of a resilient cushioning material 35 (seen in the cut views of FIGS. 14-15). The first tubular pillow 20 extends from a left distal end 21 to a right distal end 29, with a first medial portion 26 in a central area of the tubular shape disposed between the left distal end 21 and the right distal end 29. Disposed within the first medial portion 26 is a first pillow lateral flexure-enabling element 25 that at least substantially, and preferably wholly, divides the first tubular pillow 20 into two chambers—a longitudinally-elongated first pillow left chamber 22 and a longitudinally-elongated first pillow right chamber 28. The first pillow lateral flexure-enabling element 25 is configured to facilitate the manual bending of the first tubular pillow 20, such as illustrated in FIG. 2 in which the first pillow left chamber 22 is arranged snuggly alongside the right side of the head and upper body of the infant while the first pillow right chamber 28 is arranged snuggly alongside the left side of the head and upper body of the infant 90.

The first tubular pillow 20 may be between 2 inches and 6 inches in width and is preferably between 2.5 and 3.5 inches in width. The first tubular pillow 20 may be between 18 and 32 inches in length and is preferably between 22 and 26 inches in length. The tubular pillow 20 may weigh between 0.4 and 2 pounds and is preferably between 0.5 and 1.5 pounds. Experimentation has shown that a preferred size of the first tubular pillow 20 is 24 inches in length, 3 inches in width, and weighs 1 pound.

The second tubular pillow 40 is structurally similar to the first tubular pillow 20 having a longitudinally elongated form and having an outer shell 44 that encloses and contains an amount of a resilient cushioning material 35 (FIGS. 16-17) but is preferably further configured with two attached straps and preferably has a width that is greater than the width of the first tubular pillow 20. The second tubular pillow 40 extends from a left distal end 41 to a right distal end 49 with a central second medial portion 46 configured with a second pillow lateral flexure-enabling element 45, which substantially or wholly divides pillow 40 into two chambers—a longitudinally-elongated second pillow left chamber 42 and a longitudinally-elongated second pillow right chamber 48. The second pillow lateral flexure-enabling element 45 is configured to facilitate the manual bending of the second tubular pillow 40, such as illustrated in FIG. 2 in which the second pillow left chamber 42 and second pillow right chamber 48 are manually positioned adjacent to the right and left sides of the infant's lower body, respectively. The second tubular pillow 40 may be between 18 inches and 32 inches in length and is preferably between 22 and 26 inches in length. Though both tubular pillows 20, 40 may be the same width, preferably the width of the second tubular pillow 40 is greater than the width of the first tubular pillow. The second tubular pillow 40 may be between 2 inches and 7 inches in width and is preferably between 3.5 and 4.5 inches in width. Tubular pillow 40 may weigh between 1 and 3 pounds and is preferably between 1.0 and 2.0 pounds. Experimentation has shown that a preferred size is the second tubular pillow 40 is 24 inches in length and 4 inches in width with straps 50 that are 2 inches wide and 18 inches long.

The second tubular pillow 40 is preferably configured with two straps 50A, 50B (referred to generally as straps 50). The straps 50A, 50B are each formed of a thin, flat strip of material, which may be seamed or unseamed. The material of straps 50A, 50B may be the same fabric used to form the second tubular pillow 40 or may be of a different type of fabric. The straps 50A, 50B are attached at or near the left distal end 41 and at or near the right distal end 49 of pillow 40 at attachment points 51A and 51B, respectively. Straps 50A, 50B are preferably between half the length of pillow 40 and the length of pillow 40. Each of straps 50A, 50B may be between 1.0 and 4.5 inches in width and between 14 and 24 inches in length, and are preferably between 1.5 and 2.5 inches in width and between 16 and 20 inches in length. An exemplary construction method to form each strap 50A, 50B is to procure a single piece of fabric having a length of the desired strap length plus two seam allowances and having a width of the desired strap width plus two seam allowances, folding the fabric piece in half, seaming along the long side of the folded fabric to form a tube, turning the tube to position the seam on the inside, seaming along the short distal end to close the distal end of tube, and sewing the proximal end of the strap in place (generally within the seam line 43) on the second tubular pillow 40. A second exemplary construction method to form the straps 50 is to utilize a piece of material with self-bound edges, such as a ribbon, braid, narrow knitted tube or band, self-edged tape, or other material which is constructed so as not to ravel along the edges, thus removing the necessity of seaming the outer edges.

Figure 3:
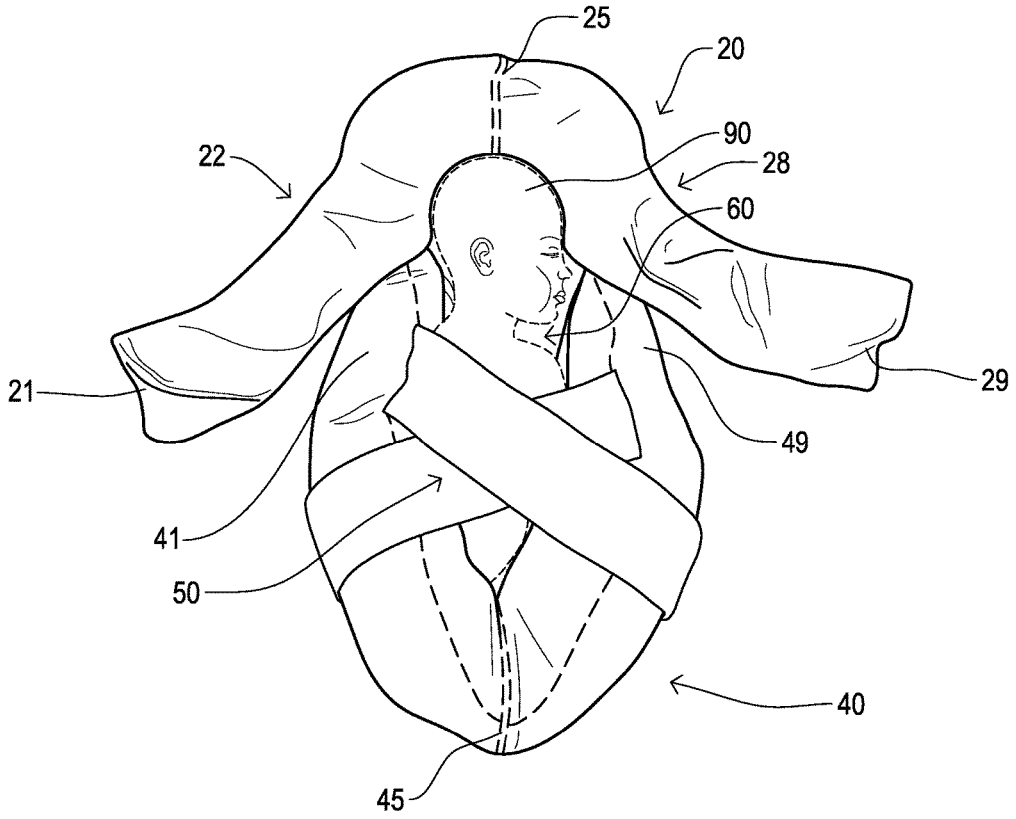
FIG. 3 is a top view of the modular, deformable, cushioned, resistive infant positioning system and method of the present invention in the environment of use with the infant in a side-lying position in an isolette.

The lateral flexure-enabling elements 25, 45 of tubular pillows 20, 40, respectively, are configured to allow the bending or flexing of the tubular pillows 20, 40 at a generally central location. The lateral flexure-enabling elements 25, 45 may be created in any of a variety of methods that facilitate the bending at a central location of the pillows 20, 40. For example, the lateral flexure-enabling elements 25, 45 may be formed by a seam, as shown in FIG. 1; may be formed by multiple seams, as shown in FIG. 3; may be formed by corresponding connectors; may be formed by an articulating joint; or may be formed in other known methods of construction to allow a first segment (left chamber 22, 42) to articulate with respect to a second segment (right chamber 28, 48).

The outer shells 24, 44, 64 (FIGS. 1, 14-19) of the first tubular pillow 20, second tubular pillow 40 and compact pillow 60 respectively, may be formed of a single piece of fabric or multiple pieces of fabric joined to form an initial piece of fabric. In an exemplary construction method to form the tubular pillows 20, 40, the initial fabric piece 24, 44 may be folded in half and then sewn along one longitudinal peripheral edge along seam line 23, 43 (FIGS. 1, 14-17). The lateral flexure-enabling element 25, 45 may then be created by seaming along a single or multiple seam line or may be created by another disclosed means or means as is known in the art. Then a pre-determined amount of the cushioning material 35 is placed into the longitudinally-elongated first pillow and second pillow left chambers 22, 42 and the left distal ends 21, 41 are closed by sewing along seam line 37, 57, respectively. A second pre-determined amount of the cushioning material 35 is placed into the longitudinally-elongated right chambers 28, 48 and the right distal ends 29, 49 are closed by sewing along seam line 36, 56, respectively. Other construction methods as will be obvious to those skilled in the art are usable to construct one or more of the pillows 20, 40, 60. These variations include forming the pillow 20, 40, 60 from an upper and a lower panel of the same or of varying fabrics with peripheral seams 23, 43, 84 (FIGS. 14-19) and opposing peripheral seams 37, 53, 91 (FIGS. 15-16, 19) created along opposing long edges; forming the pillow 20, 40, 60 from multiple fabric pieces, such as with an upper terrycloth fabric panel sewn to a lower tightly woven smooth fabric; using one or multiple types of seams, such as plain, lapped, abutted, French, fabric welded, or bound seams; sewing the seams in different orders; and other sewing construction means, as are known in the art.

Figure 18:
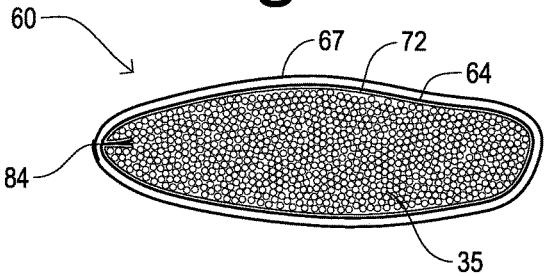
FIG. 18 is a cross-sectional view of a first aspect of the compact pillow of the present invention.
Figure 19:
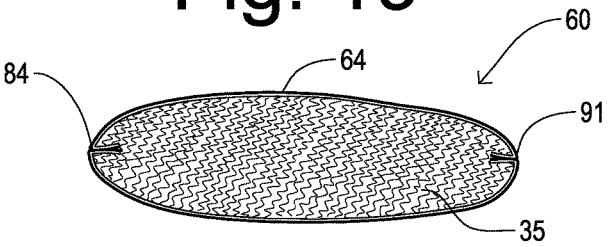
FIG. 19 is a cross-sectional view of a second aspect of the compact pillow of the present invention.

The third pillow, compact pillow 60, extends from lateral peripheral edge 63 to opposing lateral peripheral edge 73 and from longitudinal peripheral edge 83 to opposing longitudinal peripheral edge 93. The compact pillow 60 includes an outer shell 64 (FIGS. 1, 18-19) that encloses and contains a pre-determined amount of a resilient cushioning material 35 (FIGS. 18-19). The compact pillow 60 is preferably square or rectangular with the lateral side width only slightly smaller than the longitudinal side length, but may alternatively be formed in other compact shapes, such as square, oval, circular, hexagonal, irregular, or the like. The compact pillow 60 is preferably under 12 inches in width and in length.

The outer shell 64 of the compact pillow 60, as shown in FIGS. 18-19, may be formed of a single piece of fabric or of multiple joined pieces of fabric. In an exemplary single panel construction method, the compact pillow 60 may be formed by folding the fabric piece in half along the central, longitudinal fold line at lateral peripheral edge 63 and sewing along two of the three edges 73, 83, 93. Then an amount of the cushioning material 35 is placed into the pocket created, and the remaining open peripheral edge of the three edges 73, 83, 93 is sewn to enclose the cushioning material 35 and to close the outer shell 64 of the compact pillow 60.

A two panel construction method may be used with any of the three pillows 20, 40, 60. A first panel of a first fabric type, fabric weight, fabric structure or fabric material may be attached along a first seam line to a second panel of the same fabric or of a fabric having a different type, weight, structure or material. Thus the first seam would substitute for the fold line described in the single panel construction methods described.

The outer shells 24, 44, 64 of the three pillows 20, 40, 60 are preferably formed of a soft, natural, hypoallergenic fabric, such as cotton, linen, bamboo, hemp, or silk fabric, but other natural or man-made materials can also be used, such as wool, lyocell, model, viscose, acetate, nylon, rayon, synthetics, and the like. The fabric may be formed of one type of fiber or of multiple types of fibers. The structure of the fabric may be woven, non-woven, fleece, flannel, terrycloth or the like. The type of fabric used to form the three outer shells 24, 44, 64 of the three pillows 20, 40, 60 may be identical or may vary between the different pillows 20, 40, 60. Most preferably, the outer fabric of outer shells 24, 44, 64 is pure cotton flannel. Preferably an inner casing 32, 52, 72 (FIGS. 14, 17, 18) is used inside the outer shells 24, 44, 64 to contain the cushioning material 35. Optionally, a removable exterior case 27, 47, 67 (FIGS. 14, 17, 18) may be provided to protect the outer shells 24, 44, 64. The exterior case 27, 47, 67 may be removed from the inner pillow for laundering. It may be formed with a zipper, complementary hook and loop closure mechanisms, or other closure means. The inner casing 32, 52, 72 and optional exterior case 27, 47, 67 may be formed in a similar manner to the construction method described for the outer shells 24, 44, 64.

The cushioning material 35 (FIGS. 14-19) comprises a filling-type material that is manipulatable, moveable and/or transferable by relocating, reorienting or displacing a portion of the cushioning material 35 via manual manipulation through the outer shell 24. Because the inner cushioning material 35 is able to be moved about inside the pillows 20, 40, 60, the clinician can manipulate the cushioning material 35 to distribute the weight of the pillow or to better position the infant's head or body. The cushioning material 35 may be particulate or gel. Particulate cushioning material includes polyurethane pellets/beads, polyester pellets, micro beads, polystyrene pellets, seeds or herbs (such as buckwheat, millet, flaxseed, lavender, hemp and the like) and similar known filling materials. Through experimentation, it has been found that the preferred particulate cushioning material 35 is clear, flat, oval polypropylene pellets of uniform shape and size weighing between 1.75 and 2.75 ounces per cup, and preferably 2.25 ounces per cup.

Method of Use

The modular, deformable, cushioned, resistive infant positioning system 100 is usable for positioning and repositioning an infant while providing support with boundaries, calming and stress relief, and correction/prevention of head shape deformities in an isolette, in a crib and in other environments. Depending on the situation, need, and circumstances, the cushioned, resistive infant positioning system 100 may be used to meet aspects of all these objectives simultaneously or may be used to meet one (or more) of the objectives independently. For discussion purposes, each of these uses will be considered separately. FIGS. 2-7 illustrate methods of use of the cushioned, resistive infant positioning system 100. The use of the cushioned, resistive infant positioning system 100 is also shown in a diagrammatic form in FIGS. 8-13.

Infants can be placed in prone, supine or side-lying positions; different positions are appropriate for different situations. The goal in the NICU is to place the infant in any of a variety of positions that are appropriate for the particular infant at the particular time with the positions providing flexion, containment, alignment and comfort while allowing the infant some movement against boundaries. The cushioned, resistive infant positioning system 100 is designed to be situated and resituated into advantageous configurations by the nursing staff to meet these positioning goals. In general, in the isolette the infant may be placed in prone, supine or side-lying positions, while in the open crib the infant is placed on the back following the recommendation given in 1992 by the American Academy of Pediatrics (AAP) that infants be placed for sleep in a non-prone position. The infant would typically be kept in NICU in an isolette while weighing from less than 1 pound up to 4 pounds. At about 4 pounds in weight, the infant can generally maintain his or her body temperature, so is then moved to the open crib.

The utilization of the cushioned, resistive infant positioning system 100 to place the infant in various positions will be herein discussed without regard to the determination of which position is appropriate for which situation, which may be determined by nursing staff, doctors and other clinical experts. Though the positioning is herein discussed substantially in view of use in the NICU, some or all of the positioning discussed in that regard may also be appropriate for, and utilized in, the nursery, home or other childcare situations.

Figure 23:
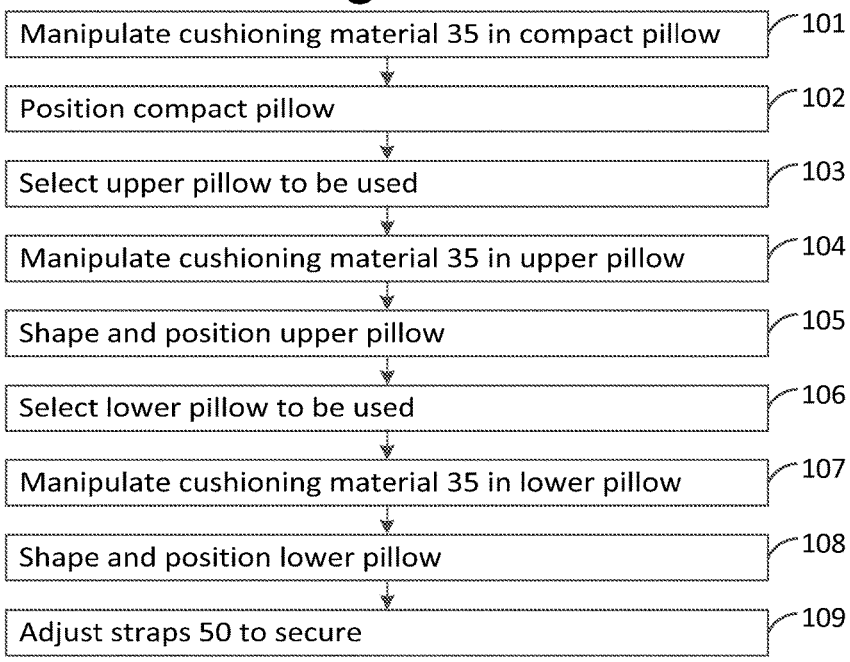
FIG. 23 is a flowchart illustrating a generalized method of use of the modular, deformable, cushioned, resistive infant positioning system of the present invention.

Broadly, referring to FIG. 23, to use the cushioned, resistive infant positioning system 100 the compact pillow 60 is chosen and the inner cushioning material 35 is manipulated 101 as desired for the particular application. The compact pillow 60 is then shaped and positioned as desired 102. The compact pillow 60 may be used under the head for support, or, if not needed in that capacity, may be used in accessory uses, such as to protect an IV site, to support ventilator lines, to prop continuous positive airway pressure (CPAP) lines, to secure air lines, or the like. Then, an upper tubular pillow (generally the first tubular pillow 20) is selected 103, the inner cushioning material 35 is manually manipulated 104, and the upper pillow is placed adjacent to (near, around, over, or under) the infant's upper torso and head 105. Then, the lower tubular pillow (generally the second tubular pillow 40) is selected 106, the inner cushioning material 35 is manually manipulated 107, the pillow is shaped (generally in U-shaped configuration) and positioned 108 adjacent to (near, around, over, or under) the infant's lower body. The straps 50 are then adjusted to secure the pillows in the proper position 109, such as being crossed and tucked around the infant or with ends 59A, 59B (FIG. 1) under or over the opposing pillow.

A first exemplary use of the cushioned, resistive infant positioning system 100 to position an infant in the supine position is shown in FIG. 2. If the infant can tolerate the supine position in the isolette, a clinician may use the inventive positioning system 100 to position the infant into the supine position. The clinician can use the compact pillow 60 for receiving the infant's head. Before use, the clinician can manipulate the cushioning material 35 of the compact pillow 60 as needed, such as to prevent a chin tuck, which can lead to apnea in premature infants. The clinician can then place the infant's head on the manipulated compact pillow 60. The clinician then bends the first tubular pillow 20 at first pillow lateral flexure-enabling element 25 and places the inner edges of the longitudinally-elongated left and right chambers 22, 28 adjacent to the right and left sides of the infant's head, touching the sides of the top portion of the head. The distal ends 21, 29 can be placed on the infant's shoulders for calming, can be positioned outside of the second tubular pillow 40 or can be curved outward. By placing the infant's head directly in midline and by providing light pressure on the posterior of the skull, the infant's head "rounds out" and scaphocephaly is prevented. The second tubular pillow 40 can be bent at the second pillow lateral flexure-enabling element 45 and formed into a U-shape for placement around the legs and trunk of the infant, touching the outer sides of the legs and trunk to provide containment with some movement against boundaries. The second tubular pillow 40 also supports the infant and prevents the infant from slipping downward in the isolette. Straps 50 can be crossed and tucked under the opposing sides of second tubular pillow 40 to maintain pillow 40 adjacent to the infant.

FIG. 3 shows an exemplary use of the cushioned, resistive infant positioning system 100 to position an infant in the side-lying position. The clinician places a side of the infant's head upon the compact pillow 60 with the softness of the pillow 60 helping to prevent severe head shape deformities which can occur from lying on the firm mattress. The first tubular pillow 20 is then bowed at first pillow lateral flexure-enabling element 25 so that the inner portion of the center right chamber 22 can be placed alongside the top of the right side of the infant's head and with the left chamber 28 placed touching the opposite side of the head. The distal ends 21, 29 can be curved upward and outward. The second tubular pillow 40 is then bent at the second pillow lateral flexure-enabling element 45 to form a U-shape. It may then be situated against the legs of the infant to provide containment, to gain flexion, or to contribute to the infant's comfort. Or a portion of the second tubular pillow 40 may be rested on the infant for calming purposes. The straps 50 may be crossed and tucked under the body of the second tubular pillow 40 to secure it in the selected position.

Figure 4:
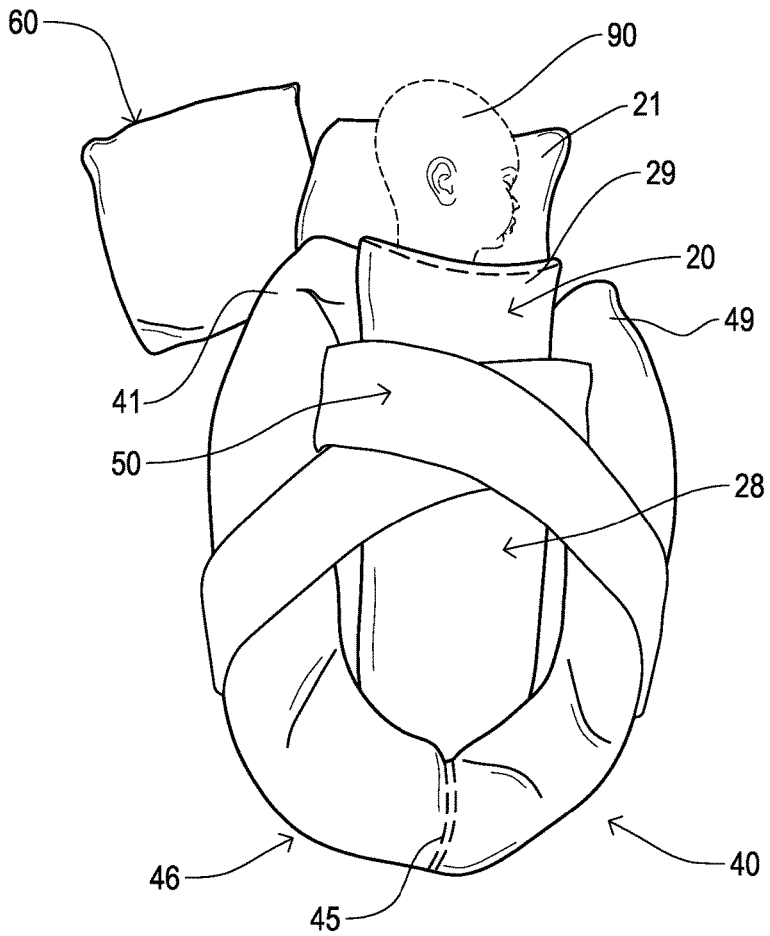
FIG. 4 is a top view of the modular, deformable, cushioned, resistive positioning and repositioning and method of the present invention in the environment of use with the infant in a prone position in an isolette.
Figure 5:
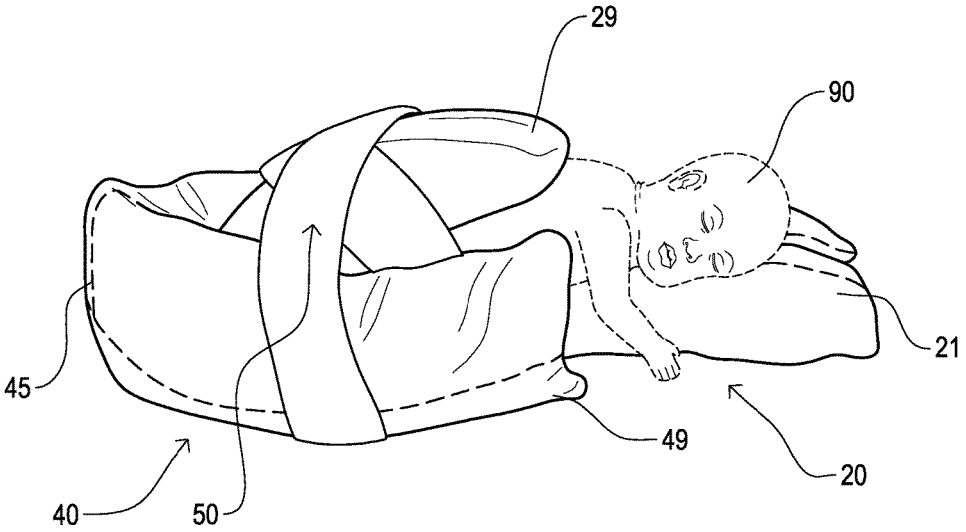
FIG. 5 is a side view of the modular, deformable, cushioned, resistive positioning and repositioning and method of the present invention in the environment of use with the infant in a prone position in an isolette.

An exemplary use of the cushioned, resistive infant positioning system 100 to position an infant in the prone position is shown in FIGS. 4-5. In the prone position in the isolette the infant can be placed on one half of the first tubular pillow 20 to encourage flexion of the arms and legs. For example, the clinician places the longitudinal centerline of the first tubular pillow 20 generally along the longitudinal centerline of the flat, rectangular surface of the isolette, with, for example, the left distal end 21 at the top of the isolette. The head of the infant is placed on the left distal end 21 with the infant's body generally aligned with the centerline of the first tubular pillow 20. The first medial portion 26 of the first tubular pillow 20 is then brought upward between the legs (with the resilient cushioning material 35 manipulated, if needed, to create comfortable leg indentations). The remaining portion of the first tubular pillow 20, the first pillow right chamber 28 with right distal end 29, is then rested upon the back of the infant. The second tubular pillow 40 is then manually curved at the second pillow lateral flexure-enabling element 45 to form a U-shape, and is then placed around the infant's feet, touching the feet and sides of each leg for containment. The straps 50 may be crossed and wrapped around and under the opposing sides of the second tubular pillow 40 to maintain the infant in the prone position on the first tubular pillow 20 and to secure the second tubular pillow 40 close to the infant's torso. The compact pillow 60 can be used in any accessory use, such as to direct or support lines or equipment within the isolette.

Figure 6:
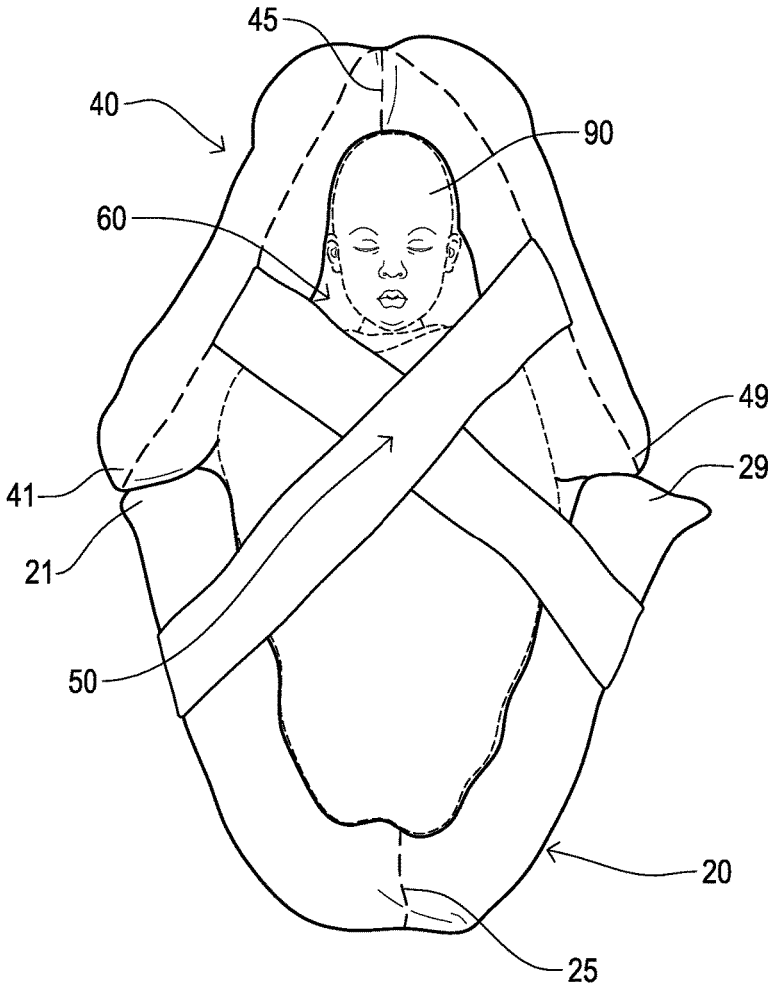
FIG. 6 is a top view of the modular, deformable, repositionable, cushioned gentle cushioned, resistive infant positioning system and method of the present invention in the environment of use with the infant in a supine position in a crib.

FIG. 6 shows an exemplary use of the cushioned, resistive infant positioning system 100 with an infant in an open crib. The infant is swaddled and lies on his back with his head placed on the compact pillow 60. The second tubular pillow 40 is shaped into a U-shape and placed directly around the head with the inner sides of pillow 40 touching the sides of the head. The first tubular pillow 20 is shaped into a U-shape and placed around the legs of the infant to prevent the infant from sliding down in the crib, which is often a problem because the head of the crib is generally elevated to reduce the possibility of reflux. Without support at the feet from first tubular pillow 20, the infant could easily slide down in the crib and off of the compact pillow 60 and away from the upper second tubular pillow 40. The straps 50 are crossed and tucked under the lower first pillow 20, thus securing the pillows 20, 40 around the infant in the selected placement. This positioning is useful for correcting a head shape deformity that has already occurred or preventing a deformity from occurring when the infant is still very small.

Figure 7:
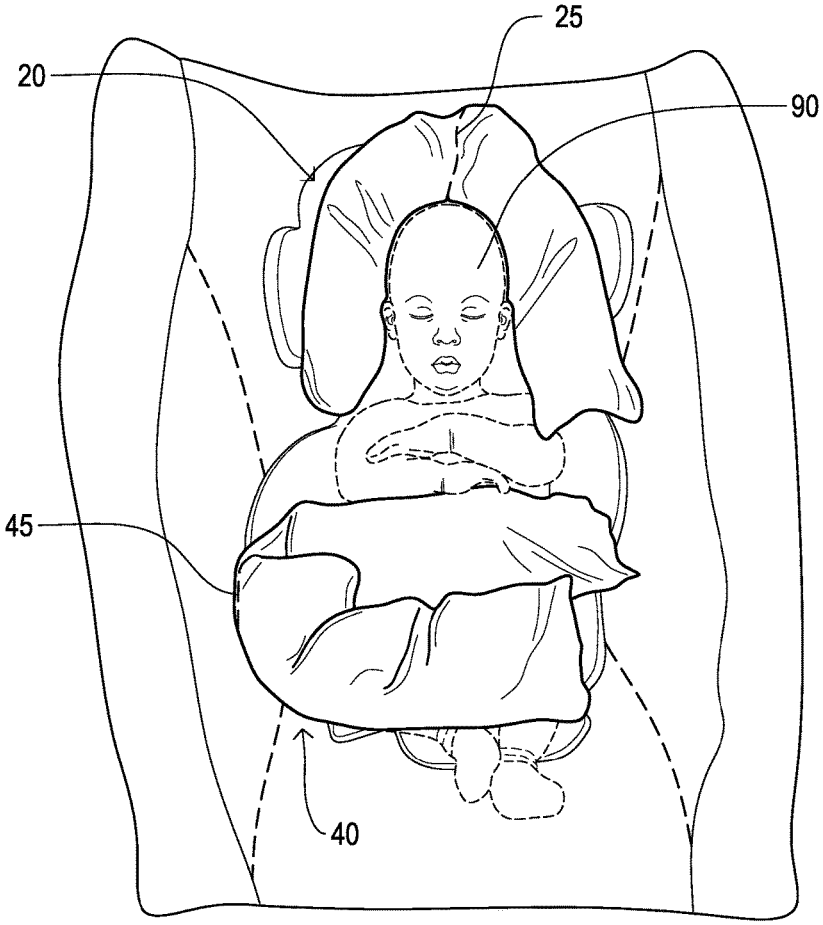
FIG. 7 is a front view of the modular, deformable, repositionable, cushioned gentle cushioned, resistive infant positioning system and method of the present invention in the environment of use with the infant in a seated position, such as in an infant car seat or swing.
Figure 8:
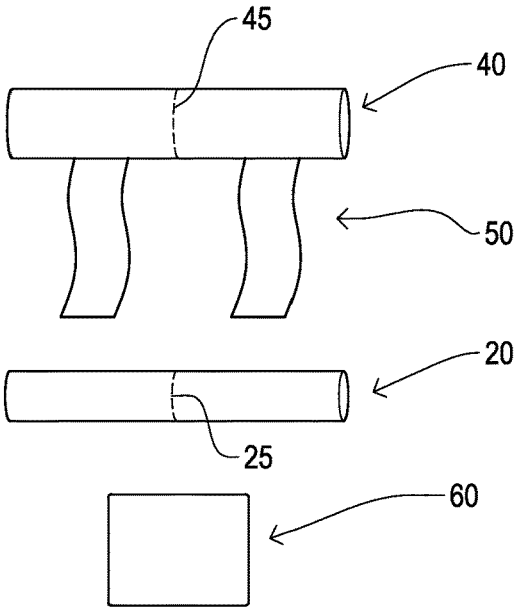
FIG. 8 is a diagrammatic view of the three pillows of the modular, deformable, repositionable, cushioned gentle cushioned, resistive infant positioning system and method of the present invention.
Figure 9:
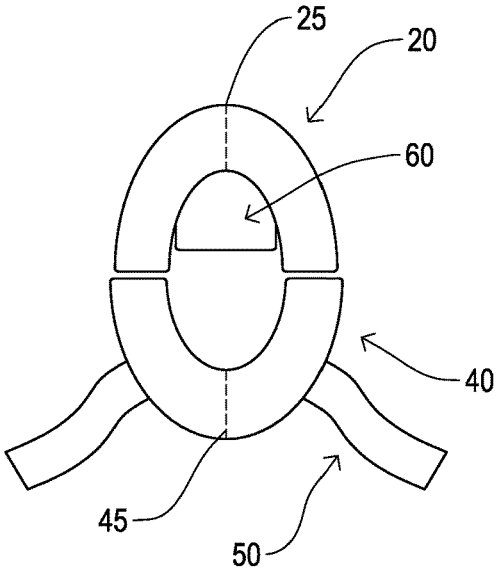
FIG. 9 is a diagrammatic view of an exemplary placement of the three pillows of the present invention for receiving an infant in the supine position, such as in an isolette.
Figure 10:
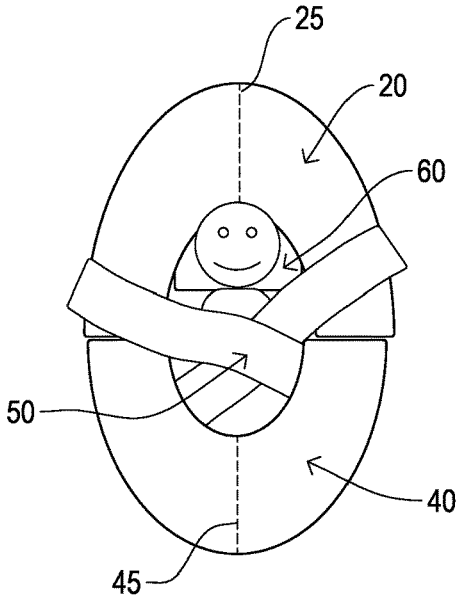
FIG. 10 is a diagrammatic view of an exemplary placement of the three pillows of the present invention with an infant in the supine position, such as in an isolette.
Figure 11:
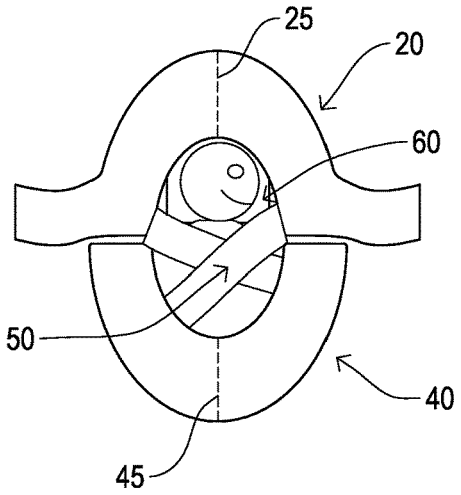
FIG. 11 is a diagrammatic view of an exemplary placement of the three pillows of the present invention with an infant in the side-lying position, such as in an isolette.
Figure 12:
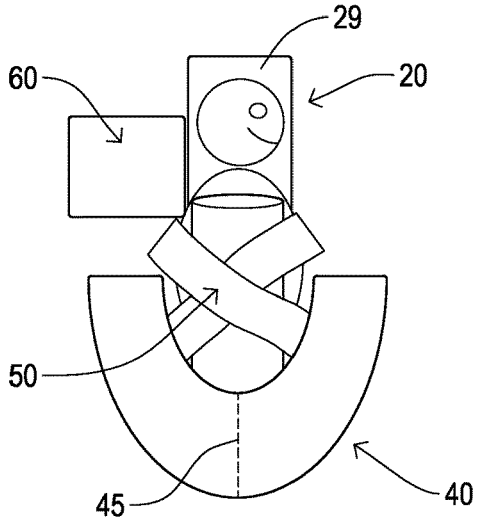
FIG. 12 is a diagrammatic view of an exemplary placement of the three pillows of the present invention with an infant in the prone position, such as in an isolette.
Figure 13:
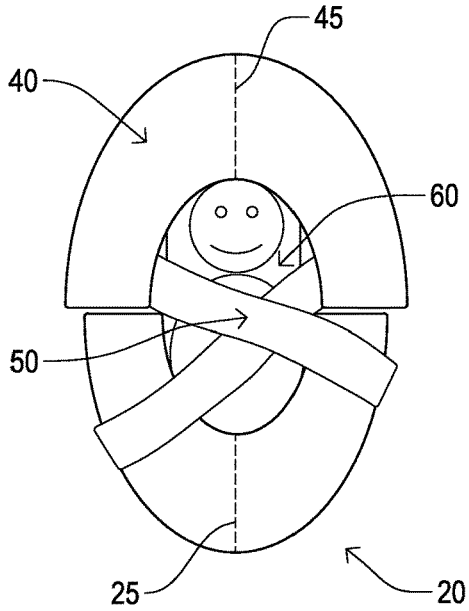
FIG. 13 is a diagrammatic view of an exemplary placement of the three pillows of the present invention with an infant in the supine position, such as in a crib.

FIG. 7 shows an exemplary use of the cushioned, resistive infant positioning system 100 with a slightly older infant in a car seat, bouncy seat, baby swing or the like. If the infant is discharged but still needs correction of a head shape deformity (for example, scaphocephaly), a parent can be instructed on the use of the positioning system 100. For instance, the parent may be given the instructions to use the positioning system 100 for "x" number of hours per day. The infant's head is positioned on the compact pillow 60 with one of the tubular pillows 20, 40 folded around the head. If desired, the other one of the tubular pillows 20, 40 can be folded against itself and laid upon the lower torso of the infant for calming.

FIGS. 8-13 show diagrammatically the positions discussed above. When the modular, deformable, cushioned, resistive infant positioning system 100 is in use within the NICU environment, the diagrammatic images may be displayed in any of various informative presentations to assist the clinicians in advantageously positioning the infant. For instance, the diagrams may be incorporated into support or instructional materials for presentation to clinicians, may be displayed on a poster near the area of use (for instance on an NICU wall), may be printed on sheets or bedding usable on the isolette mattress, may be printed on a laminated placard for attachment to an isolette, or may be used in other similar informative presentations.

FIGS. 14-15 illustrate that the first tubular pillow 20 may be formed of a single piece of fabric seamed at seam line 23, may be formed of multiple panels seamed at seam lines 23, 37, may be formed with or without a removable outer casing 27, and may be filled with various types of manipulatable resilient cushioning material 35, such as the beads of FIG. 14 or the gel of FIG. 15.

Figure 16:
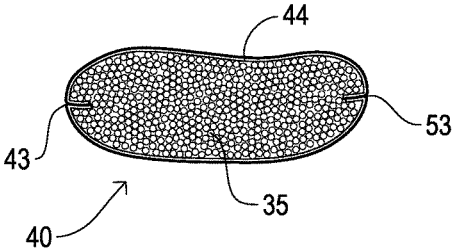
FIG. 16 is a cross-sectional view of a first aspect of the second tubular pillow of the present invention.
Figure 17:
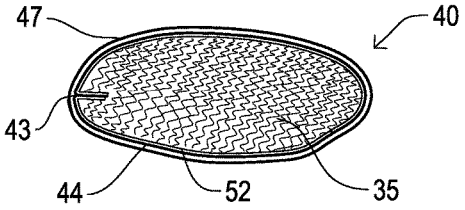
FIG. 17 is a cross-sectional view of a second aspect of the second tubular pillow of the present invention.

FIGS. 16-17 illustrate that the second tubular pillow 40 may likewise be formed of a single piece of fabric seamed at seam line 43, may be formed of multiple panels seamed at seam lines 43, 53, may be formed with or without a removable outer casing 47, and may be filled with various types of manipulatable resilient cushioning material 35, such as the beads of FIG. 16 or the gel of FIG. 17.

FIGS. 18-19 illustrate that the compact pillow 60 may also be formed of a single piece of fabric seamed at seam line 84, may be formed of multiple panels seamed at seam lines 84, 91, may be formed with or without a removable outer casing 67, and may be filled with various types of manipulatable resilient cushioning material 35, such as the beads of FIG. 18 or the gel of FIG. 19.

Figure 20:
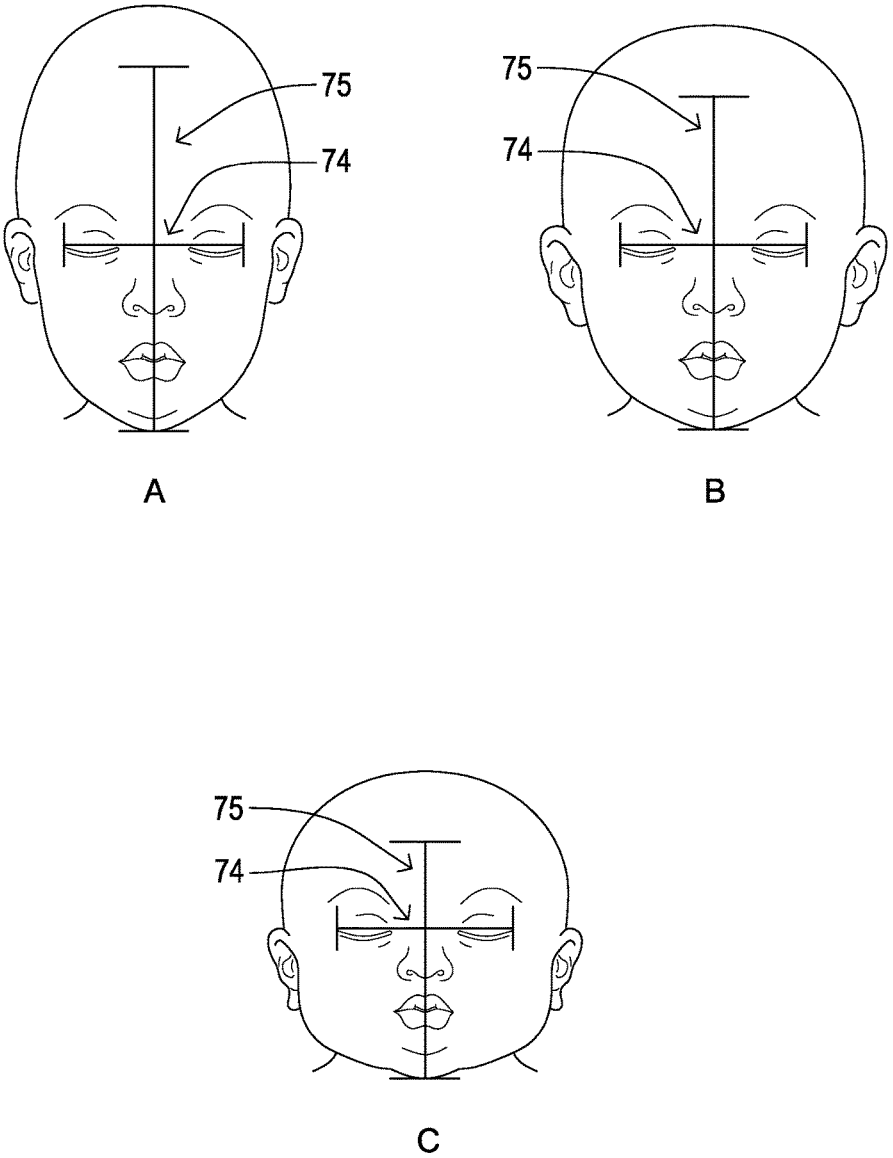
FIG. 20 is a diagrammatic view of measurements taken to determine head deformities.
Figure 21:
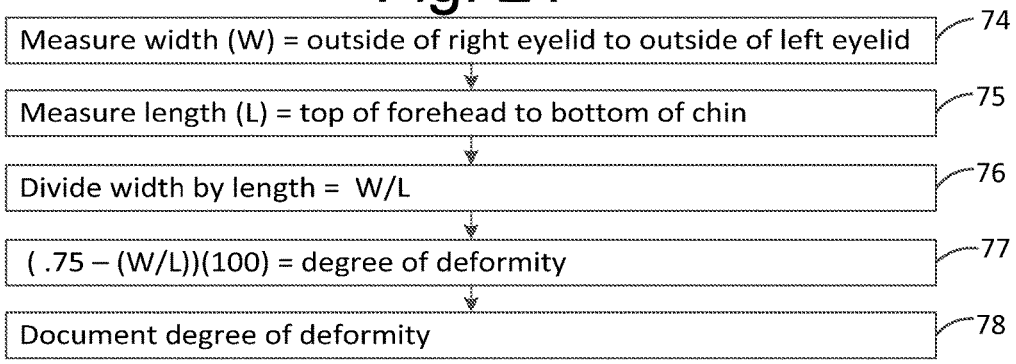
FIG. 21 is a flowchart illustrating the method of determining the degree of head deformity.

FIG. 20 shows three exemplary infant head proportions with lines to show the length and width measurements to be taken. The width (W) 75 is measured from the outer corner of the right eyelid to the outer corner of the left eyelid. The length (L) 70 is measured from the top of the forehead to the bottom of the chin. FIG. 21 shows the method used to determine the occurrence and/or severity of head shape deformity, using the measurements shown in FIG. 20. The diagram of infant A shows a head shape deformity of 26% and the diagram of infant B shows a head shape deformity of 19%, both of which indicate the need for the use of the cushioned, resistive infant positioning system 100. The diagram of infant C shows an infant with normal head proportions, such as after use of the cushioned, resistive infant positioning system 100. The normal head proportion for a newborn is L=1.34 (W).

The method to determine the degree of head deformity is presented in FIG. 21. In step 74 a width measurement (W)

is taken by measuring from the outside of the right eyelid to the outside of the left eyelid of the infant's head. In step 75 a length measurement (L) is taken by measuring from the top of the forehead to the bottom of the chin. This width measurement (W) is divided by the length measurement (L) (step 76) with the result subtracted from 0.75 and multiplied by 100 to convert the fraction to a percentage (step 77). This results in the degree of deformity, which is then documented 78. For example, if an infant has a width measurement (W) of 6 cm and a length measurement (L) of 8 cm, then W/L=0.75=75%; therefore this infant has an ideal measurement with no deformity. If an infant has a width measurement (W) of 6.75 cm and a length measurement (L) of 10.75 cm, then W/L=0.63=63%; therefore this infant has a 12% (or moderate) deformity.

Figure 22:
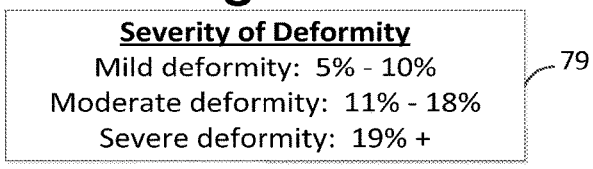
FIG. 22 is a chart illustrating the degrees of head deformity.

The degrees of head shape deformity are presented in FIG. 22. Using the method of FIG. 21, an infant with a (W/L=0.75=75%) has an ideal head proportion. Infants that have head proportions that result in 5-10% deformity have a mild deformity, while infants that have an 11-18% deformity result have a moderate deformity. Any deformity result over 18% is considered a severe deformity. The modular, deformable, cushioned, resistive infant positioning system 100 may be used to address any of these seventies, in addition to being useful to prevent head shape deformities.

From the foregoing, it will be apparent that the modular, deformable, cushioned, resistive infant positioning system and method of use of the present invention can be used for improving infant positioning (including rotating an infant through multiple advantageous positions facilitating flexion, containment, alignment, movement against boundaries, encouraging more normal musculoskeletal and neuromotor development), promoting the calming an infant, and prevention or correction of positional head deformities.

While various embodiments of the invention have been described, it will be apparent to those of ordinary skill in the art that many more embodiments and implementations are possible that are within the scope of this invention. In addition, the various features, elements and embodiments described herein may be claimed or combined in any combination or arrangement.

What is claimed is:

1. A method of using an infant positioning system (100) to position an infant, comprising:

obtaining a first tubular pillow (20) fashioned from fabric formed into a tubular shape extending from a left distal end (21) to a right distal end (29) by seaming said fabric along at least one peripheral edge to create a seamline (23) and filled with a first pre-determined amount of a manipulatable resilient cushioning material (35); said first tubular pillow (20) comprising a first pillow left chamber (22); a first pillow right chamber (28); and a first seam (25) disposed at a midpoint of said tubular shape that enables flexing of said first pillow left chamber (22) with respect to said first pillow right chamber (28) at said first seam (25);

placing the infant in a supine position;

obtaining a second tubular pillow (40) fashioned from fabric formed into a second tubular outer shell extending from a left distal end (41) to a right distal end (49) by seaming said fabric along at least one peripheral edge to create a seamline (43) and filled with a second pre-determined amount of said manipulatable resilient cushioning material (35); said second tubular pillow (40) comprising a second pillow left chamber (42); a second pillow right chamber (48); and a second seam (45) disposed at a midpoint of said tubular shape that enables flexing of said second pillow left chamber (42) with respect to said second pillow right chamber (48) at said second seam (45);

manipulating said second pre-determined amount of said manipulatable resilient cushioning material (35) within said second tubular pillow (40);

flexing said second tubular pillow (40) at said second seam (45) to form a U-shape;

positioning said second tubular pillow (40) with inward-facing portions of said second pillow left chamber (42) snuggly touching the outer left side of the infant's legs and the outer left side of the infant's trunk to create a left lower boundary;

positioning said second tubular pillow (40) with inward-facing portions of said second tubular pillow right chamber (48) snuggly touching the outer right side of the infant's legs and the outer right side of the infant's trunk to create a right lower boundary;

obtaining a compact pillow (60) filled with a third pre-determined amount of a manipulatable resilient cushioning material (35);

manipulating said third pre-determined amount of a manipulatable resilient cushioning material (35) within said compact pillow (60);

placing said compact pillow (60) adjacent the infant;

manipulating said first pre-determined amount of said manipulatable resilient cushioning material (35) within said first tubular pillow (20);

flexing said first tubular pillow (20) at said first seam (25);

positioning said first tubular pillow (20) with inward-facing portions of said first pillow left chamber (22) snuggly touching the left top of the infant's head, the left upper side of the infant's head, and the left distal end (41) of said second tubular pillow (40); and positioning said first tubular pillow (20) with inward-facing portions of said first pillow right chamber (28) snuggly touching the right top of the infant's head, the right upper side of the infant's head, and the right distal end (49) of said second tubular pillow (40).

2. The method of using an infant positioning system (100) to position an infant, as recited in claim 1, further comprising resting a portion of said second tubular pillow (40) upon the infant to provide calming.

3. The method of using an infant positioning system (100) to position an infant, as recited in claim 1, further comprising providing diagrams of alternate positions into which the infant can be positioned by utilizing said first tubular pillow (20), second tubular pillow (40), and said compact pillow (60).

4. The method of using an infant positioning system (100) to position an infant, as recited in claim 1, wherein said second tubular pillow (40) further comprises a left and right strap (50) each of which comprises a distal and proximal end; the method further comprising:

manually moving said left strap (50) distal end across the infant's body;

tucking said left strap (50) distal end under said second pillow right chamber (48);

manually moving said right strap (50) distal end across said left strap and across the infant's body; and tucking said right strap (50) distal end under said second pillow left chamber (42).

5. The method of using an infant positioning system (100) as recited in claim 1, wherein said first tubular pillow (20) comprises a first outer shell (24), said second tubular pillow (40) comprises a second outer shell (44), and said first outer shell (24) and said second outer shell (44) are formed of a hypoallergenic fabric.

6. The method of using an infant positioning system (100) as recited in claim 1, wherein said manipulatable resilient cushioning material (35) comprises polypropylene pellets.

7. The method of using an infant positioning system (100) as recited in claim 6, wherein said polypropylene pellets have a weight of between 1.75 and 2.75 ounces per cup.

8. The method of using an infant positioning system (100) as recited in claim 1, wherein said manipulatable resilient cushioning material (35) comprises a gel.

* * * * *